US010344986B2

(12) United States Patent
Yantis

(10) Patent No.: US 10,344,986 B2
(45) Date of Patent: Jul. 9, 2019

(54) DOOR ASSEMBLIES FOR APPLIANCES

(71) Applicant: Haier US Appliance Solutions, Inc., Wilmington, DE (US)

(72) Inventor: John Adam Yantis, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 264 days.

(21) Appl. No.: 15/286,645

(22) Filed: Oct. 6, 2016

(65) Prior Publication Data

US 2018/0100657 A1 Apr. 12, 2018

(51) Int. Cl.

| | |
|---|---|
| ***E05B 1/00*** | (2006.01) |
| ***F24C 15/02*** | (2006.01) |
| ***A47L 15/42*** | (2006.01) |
| ***E05C 1/14*** | (2006.01) |
| *E05B 53/00* | (2006.01) |
| *F25D 23/02* | (2006.01) |
| *E05B 15/10* | (2006.01) |

(52) U.S. Cl.

CPC ..... *F24C 15/022* (2013.01); *A47L 15/4259* (2013.01); *E05B 1/0015* (2013.01); *E05C 1/14* (2013.01); *E05B 53/003* (2013.01); *E05B 2015/107* (2013.01); *F25D 23/028* (2013.01); *F25D 2323/021* (2013.01)

(58) Field of Classification Search

CPC ..... F24C 15/022; E05C 1/14
USPC ..... 292/170; 126/197
See application file for complete search history.

(56) References Cited

U.S. PATENT DOCUMENTS

| | | | | |
|---|---|---|---|---|
| 374,391 | A | 12/1887 | Born | |
| 2009/0178663 | A1 | 7/2009 | Filippi | |
| 2014/0097172 | A1 | 4/2014 | Kang et al. | |
| 2015/0192304 | A1* | 7/2015 | Turner | F24C 15/022 126/197 |
| 2017/0108228 | A1* | 4/2017 | Park | E05C 3/16 |

* cited by examiner

*Primary Examiner* — Avinash A Savani
*Assistant Examiner* — Aaron H Heyamoto
(74) *Attorney, Agent, or Firm* — Dority & Manning, P.A.

(57) ABSTRACT

An appliance defining a vertical direction includes a door, a catch, and a door assembly. The door defines a cavity accessible through an opening. The catch may be spaced apart from the door along the vertical direction. The door assembly may include a latch assembly and a trigger. The latch assembly may include a latch movable along the vertical direction. The trigger may be coupled to the latch assembly. In addition, the trigger may be movable between a first position and a second position. When the trigger is in the first position, the latch may engage the catch. In contrast, when the trigger is in the second position, the latch may be spaced apart from the catch along the vertical direction.

10 Claims, 12 Drawing Sheets

DOOR ASSEMBLIES FOR APPLIANCES

FIELD OF THE INVENTION

The present subject matter relates generally to door assemblies for an appliance.

BACKGROUND OF THE INVENTION

Oven appliances generally include a cabinet that defines a cooking chamber for receipt of food articles for cooking and an opening for accessing the cooking chamber. Oven appliances also include a door rotatably mounted to the cabinet at the opening to permit selective access to the cooking chamber through the opening. In addition, oven appliances also include a gasket extending between the door and the cabinet at the opening of the cabinet when the door is in a closed position. The gasket can assist with insulating the cooking chamber and/or with containing cooking fumes within the cooking chamber. To ensure the door remains compressed or sealed against the gasket, certain oven appliances include a spring roller assembly that holds the door in the closed position through the engagement of, e.g., a roller and a strike plate.

However, opening the door can be a rather difficult task, because, for example, a user must pull a handle on the door with an amount of force sufficient to disengage the roller from the strike plate. More specifically, the spring roller assembly includes a spring, and the amount of force must be sufficient to compress the spring by a predetermined amount in order to disengage the roller from the strike plate. In addition, the amount of force must be sufficient to break the seal between the gasket and the door. Thus, opening the door may require a substantial amount of force.

Accordingly, an oven appliance with features for assisting with opening the door of an appliance, such as an oven appliance, would be useful.

BRIEF DESCRIPTION OF THE INVENTION

The present disclosure relates to an appliance having a door assembly. In particular, the door assembly can assist with reducing an amount of force required to move a door of the appliance from a closed position to an open position. Additional aspects and advantages of the invention will be set forth in part in the following description, or may be apparent from the description, or may be learned through practice of the invention.

In a first exemplary embodiment, an appliance defining a vertical direction includes a door, a catch, and a door assembly. The door defines a cavity accessible through an opening. The catch may be spaced apart from the door along the vertical direction. The door assembly may include a latch assembly and a trigger. The latch assembly may include a latch movable along the vertical direction. The trigger may be coupled to the latch assembly. In addition, the trigger may be movable between a first position and a second position. When the trigger is in the first position, the latch may engage the catch. In contrast, when the trigger is in the second position, the latch may be spaced apart from the catch along the vertical direction.

In a second exemplary embodiment, an oven appliance defining a vertical direction includes a cabinet, a door, a handle, a catch, and a door assembly. The cabinet may define a cooking chamber configured for receipt of food items. In addition, the cabinet may define an opening at a front portion of the cabinet. The door may be mounted to the cabinet, and the door may be selectively adjustable between an open position and a closed position to permit selective access to the cooking chamber through the opening of the cabinet. In addition, the door may define a cavity accessible through an opening. The handle may be mounted to the door. The catch may be spaced apart from the door along the vertical direction. The door assembly may include a latch assembly and a trigger. The latch assembly may include a latch movable along the vertical direction. The trigger may be coupled to the latch assembly. In addition, the trigger may be movable between a first position and a second position. When the trigger is in the first position, the latch may engage the catch. In contrast, when the trigger is in the second position, the latch may be spaced apart from the catch along the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
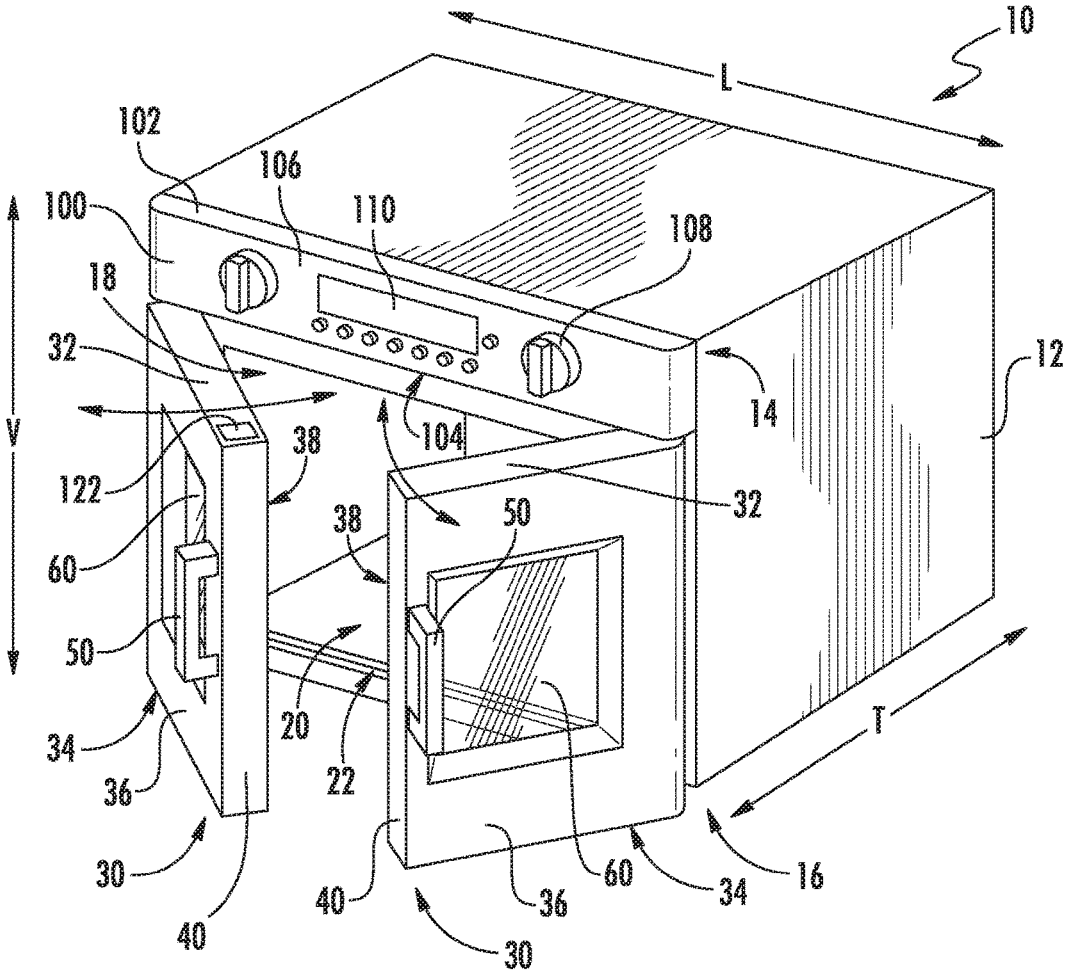
FIG. 1 provides a front, perspective view of an oven appliance according to an exemplary embodiment of the present subject matter.

Repeat use of reference characters in the present specification and drawings is intended to represent the same or analogous features or elements of the present invention

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
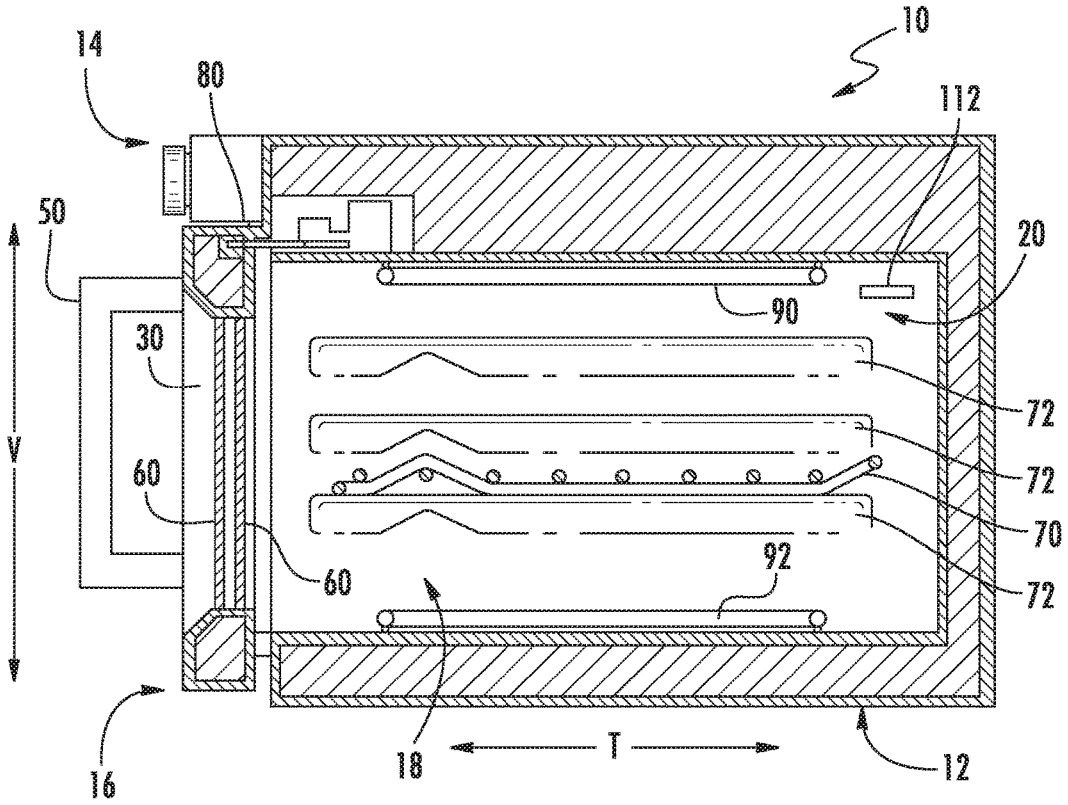
FIG. 2 provides a side, section view of the exemplary oven appliance of FIG. 1.

FIGS. 1 and 2 illustrate an oven appliance 10 according to an exemplary embodiment of the present subject matter. The oven appliance 10 defines a vertical direction V, a lateral direction L and a transverse direction T. The vertical, lateral, and transverse directions V, L, and T are mutually perpendicular and form an orthogonal direction system. As will be discussed below in more detail, the oven appliance 10 includes an insulated cabinet 12.

The insulated cabinet 12 extends between a top portion 14 and a bottom portion 16 along the vertical direction V. The cabinet 12 includes an interior surface 18 that defines a cooking chamber 20. The cooking chamber 20 is configured for the receipt of one or more food items to be cooked. The oven appliance 10 also includes a pair of doors 30 rotatably mounted on the cabinet 12 proximate an opening 22 to the chamber 20 defined by the cabinet 12. Thus, the oven appliance 10 is sometimes referred to as a French door style oven appliance.

The pair of doors 30 each include top and bottom walls 32 and 34, front and back walls 36 and 38, and opposing sidewalls 40, 42. The top and bottom walls 32, 34 are spaced apart from one another along the vertical direction V. The front and back walls 36, 38 extend between the top and bottom walls 32, 34 along the vertical direction. Further, the front and back walls 36, 38 are spaced apart from one another along the transverse direction T. The opposing sidewalls 40, 42 extend between the front and back walls 36, 38 along the transverse direction T. Further, the opposing sidewalls 40, 42 extend between the top and bottom walls 32, 34 along the vertical direction V. Still further, the opposing sidewalls 40, 42 are spaced apart from one another along the lateral direction L.

In operation, the pair of doors 30 are each configured for selectively shifting between an open position or configuration shown in FIG. 1 in which a user can access the cooking chamber 20 and a closed position or configuration shown in FIG. 2 in which the user is impeded from accessing the cooking chamber 20 by the pair of doors 30. A handle 50 is attached to each of the pair of doors 30 and assists with shifting the pair of doors 30 between the open and closed positions. Glass panes 60 provide for viewing the contents of the cooking chamber 20 when the pair of doors 30 are in the closed position as well as providing insulation between the cooking chamber 20 and the exterior of the oven appliance 10. A rack 70 is positioned within the cooking chamber 20 for the receipt of food items. The rack 70 is slidably received onto ribs/rails 72 such that the rack 70 may be conveniently moved into and out of the cooking chamber 20 when the pair of doors 30 is open. Multiple rails 72 are provided so that the height of the rack 70 may be adjusted.

One or more gaskets 80 between the pair of doors 30 and the cabinet 12 provide for maintaining heat and cooking fumes within the cooking chamber 20 when the pair of doors 30 is in the closed position as shown in FIG. 2. The one or more gaskets 80 may or may not be located around the entire perimeter of the opening 22.

Heating elements 90 and 92 are positioned within the cooking chamber 20 of the cabinet 12. The heating elements 90 and 92 are used to heat the cooking chamber 14 for both cooking and cleaning of the oven appliance 10. The operation of the oven appliance 10, including the heating elements 90 and 92, is controlled by one or more processing devices (not shown) such as a microprocessor other device that is in communication with such components.

The oven appliance 10 includes a control panel 100 comprising top and bottom walls 102, 104 and a front wall 106. The top and bottom walls 102 and 104 of the control panel 100 may be spaced apart from one another along the vertical direction V. In addition, the front wall 106 may extend between the top and bottom walls 102, 104 along the vertical direction V. The control panel 100 also includes one or more user manipulated controls 108 and a display 110. The one or more user manipulated controls 108 allow the user to make selections regarding temperature, time, and other options. The selections can be communicated to the processing device for operation of oven appliance 10. Such processing device is also in communication with a temperature sensor 112 that is used to measure temperature inside the cooking chamber 20. Although only one temperature sensor 112 is shown, it should be understood that multiple sensors can be placed within oven appliance 10 for determining the oven temperature. Further, it should be appreciated that the processing device may be in communication with the display, and user selections (e.g., temperature and/or time) may be presented on the display 110.

The oven appliance 10 of FIGS. 1 and 2 is provided by way of example only. Thus, the present subject matter may be used in any other suitable oven appliance configuration. For example, the present subject matter may be used in oven range appliances or oven appliances including a single door to provide access to a cooking chamber of the oven appliance. As a further example, the present subject matter may be used in oven range appliances or in oven appliances that define multiple interior cavities for the receipt of food and/or have different pan or rack arrangements than the exemplary embodiment shown in FIG. 2. Heating elements at the top, back, or sides of the cooking chamber 20 may also be provided, and a variety of different types of heating elements such as microwave, halogen, gas fuel, electrical resistance, and combinations thereof may be used. Other configurations may also be used as will be understood by one of skill in the art using the teachings disclosed herein.

Figure 3:
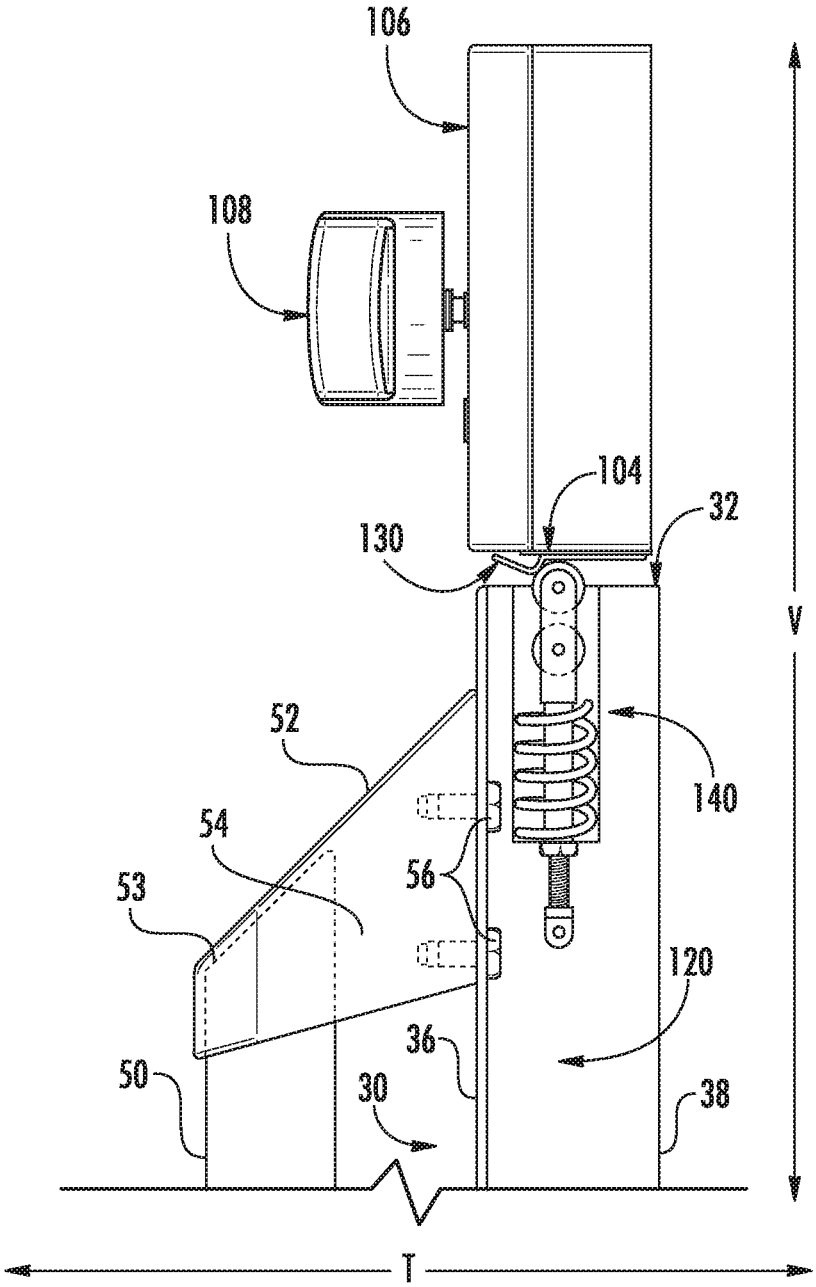
FIG. 3 provides a side, section view of an exemplary door of the oven appliance shown in FIG. 1.

Referring now to FIG. 3, an exemplary door 30 defines a cavity 120. In particular, the cavity 120 extends between the top and bottom walls 32, 34 along the vertical direction V, the front and back walls 36, 38 along the transverse direction T, and the opposing side walls 40, 42 along the lateral direction L. In addition, the cavity 120 may be accessible through an opening 122 (FIG. 1) formed on the top wall 32 of the door 30. As shown, the handle 50 of the door 30 includes a pair of mounting brackets 52 (only one shown). The mounting brackets 52 may be spaced apart from one another along the vertical direction V. More specifically, the mounting brackets 52 may each be positioned at opposing ends 53 (only one shown) of the handle 50. Further, the mounting brackets 52 may each define a cavity 54, and one of the opposing ends 53 may extend into the cavity 54. Still further, the handle 50 may be secured to the door 30 via the mounting bracket 52. In particular, the mounting bracket 52 may be secured to the front wall 36 of the door via a plurality of mechanical fasteners 56 which extend through the front wall 36 of the door 30 and a surface of the mounting bracket 52.

As shown in FIG. 3, the oven appliance 10 includes a catch or strike plate 130. The catch 130 is mounted to the bottom wall 104 of the control panel 100. More specifically, the catch 130 is spaced apart from the top wall 32 of the door 30 along the vertical direction V. The oven appliance 10 further includes a latch assembly 140 disposed within the cavity 120 formed by the door 30. As will be discussed below in more detail, the latch assembly 140 may engage the catch 130 to seal the door 30 against the gasket 80 (FIG. 2) when the door 30 is in the closed position.

Figure 4:
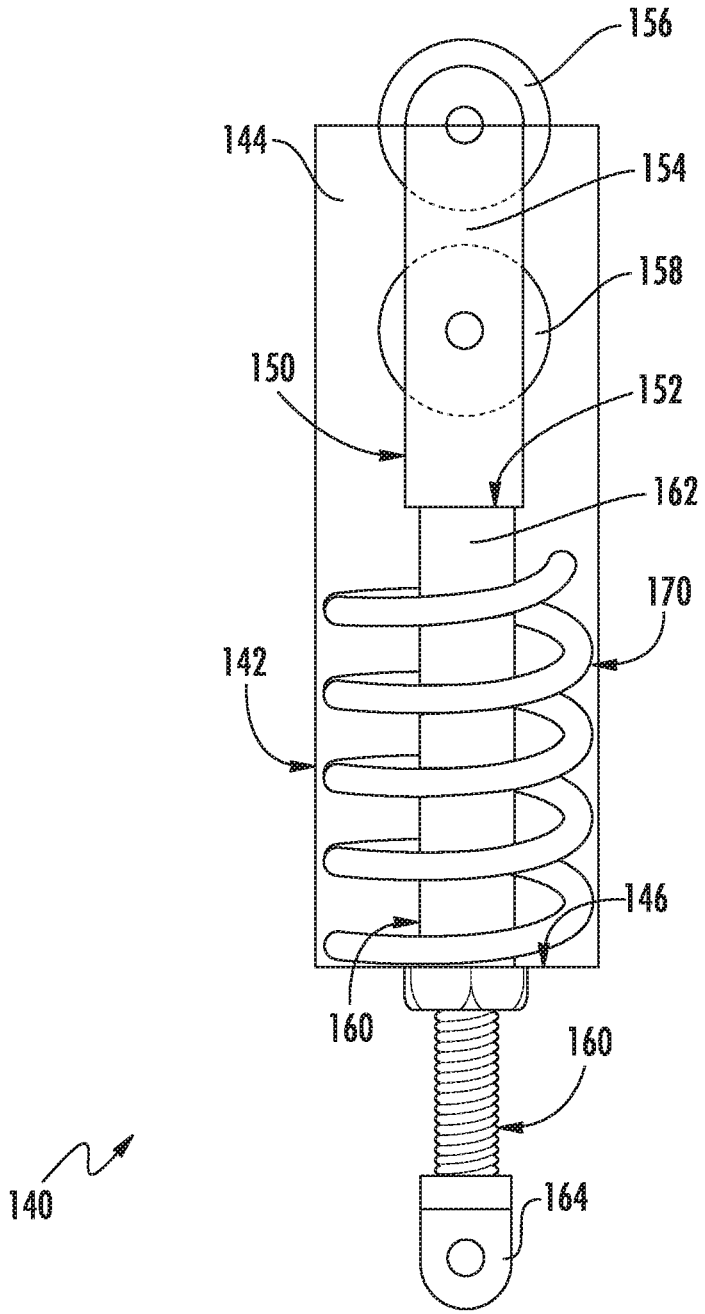
FIG. 4 provides a side view of an exemplary latch assembly.

FIG. 4 provides a side view of the latch assembly 140 which, in exemplary embodiments, may be a spring roller assembly. As shown, the latch assembly 140 includes a housing 142 defining a cavity 144. The latch assembly 140 also includes a latch 150 disposed within the cavity 144 formed by the housing 142. The latch 150 includes a bottom wall 152 and opposing side walls 154 (only one shown). The opposing side walls 154 extend from the bottom wall 152 along the vertical direction V. In addition, the opposing side walls 154 are spaced apart from one another along the lateral direction L. The latch 150 also includes a first roller 156 and a second roller 158. In particular, the first and second rollers 156, 158 extend between the opposing side walls 154 (only one shown) along the lateral direction L. Further, the first and second rollers 156, 158 are spaced apart from one another along the vertical direction V. It should be appreciated, however, that, in some embodiments, the latch 150 may not include first and second rollers 156, 158.

The latch assembly 140 also includes a rod 160 comprising a first end 162 and a second end 164. The first end 162 is disposed within the cavity 144 formed by the housing 142, and the second end 164 is disposed within the cavity 120 (FIG. 3) formed by the door 30. More specifically, the first end 162 is coupled to the bottom wall 152 of the latch 150, and the rod 160 extends from the first end 162 to the second end 164 through an opening formed in a bottom wall 146 of the housing 142.

The latch assembly 140 further includes a spring 170 disposed within the cavity 144 formed by the housing 142. More specifically, the spring 170 is positioned between the bottom wall 152 of the latch 150 and the bottom wall 146 of the housing 142 along the vertical direction V. In addition, the spring 170 extends around the rod 160. As will be discussed below in more detail, the bottom wall 152 of the latch 150 compresses the spring 170 against the bottom wall 146 of the housing 142 when the latch 150 moves towards the bottom wall 34 (FIG. 1) of the door 30 along the vertical direction V.

Figure 5:
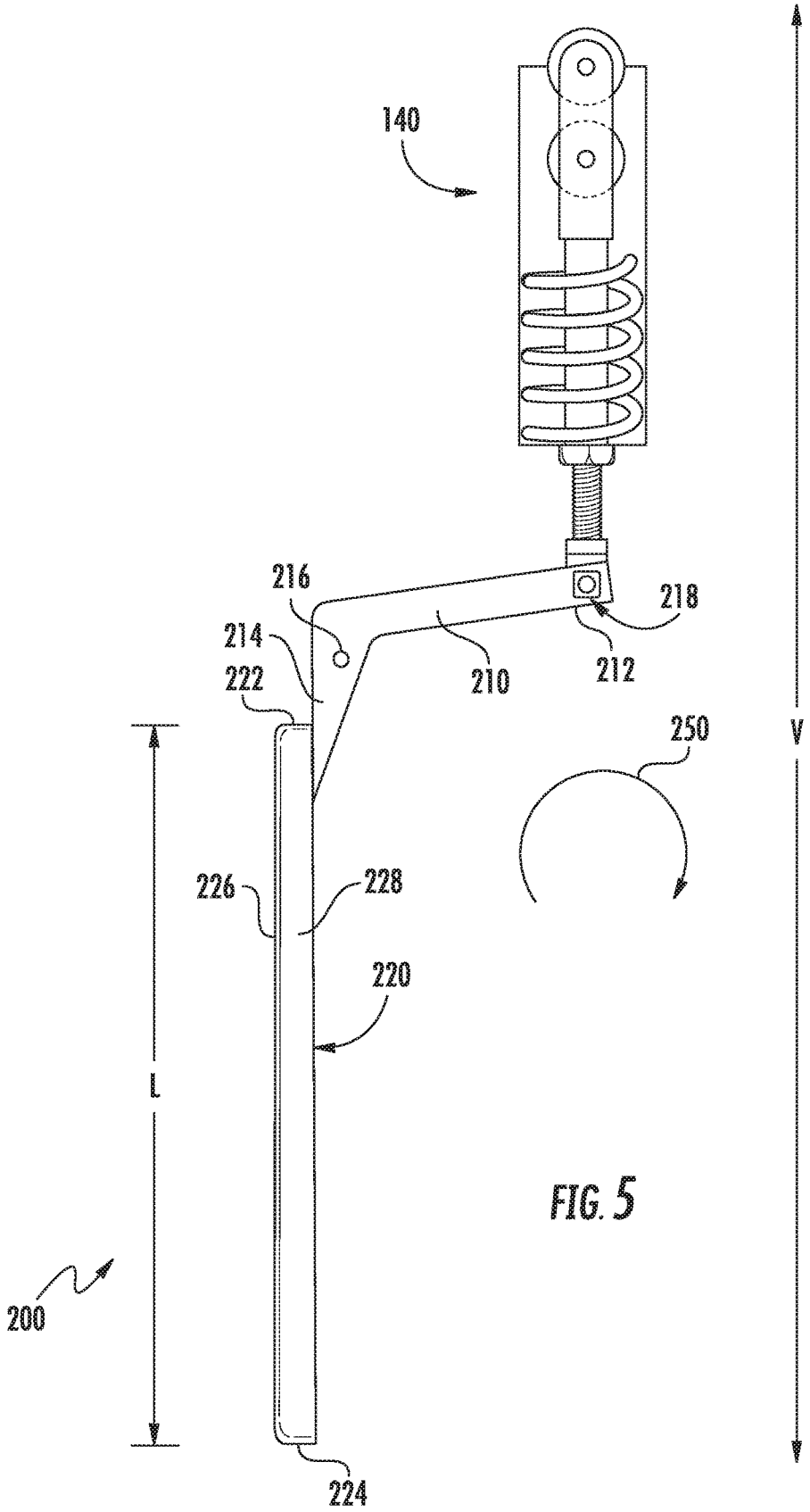
FIG. 5 depicts an exemplary door assembly in accordance with the present subject matter.
Figure 6:
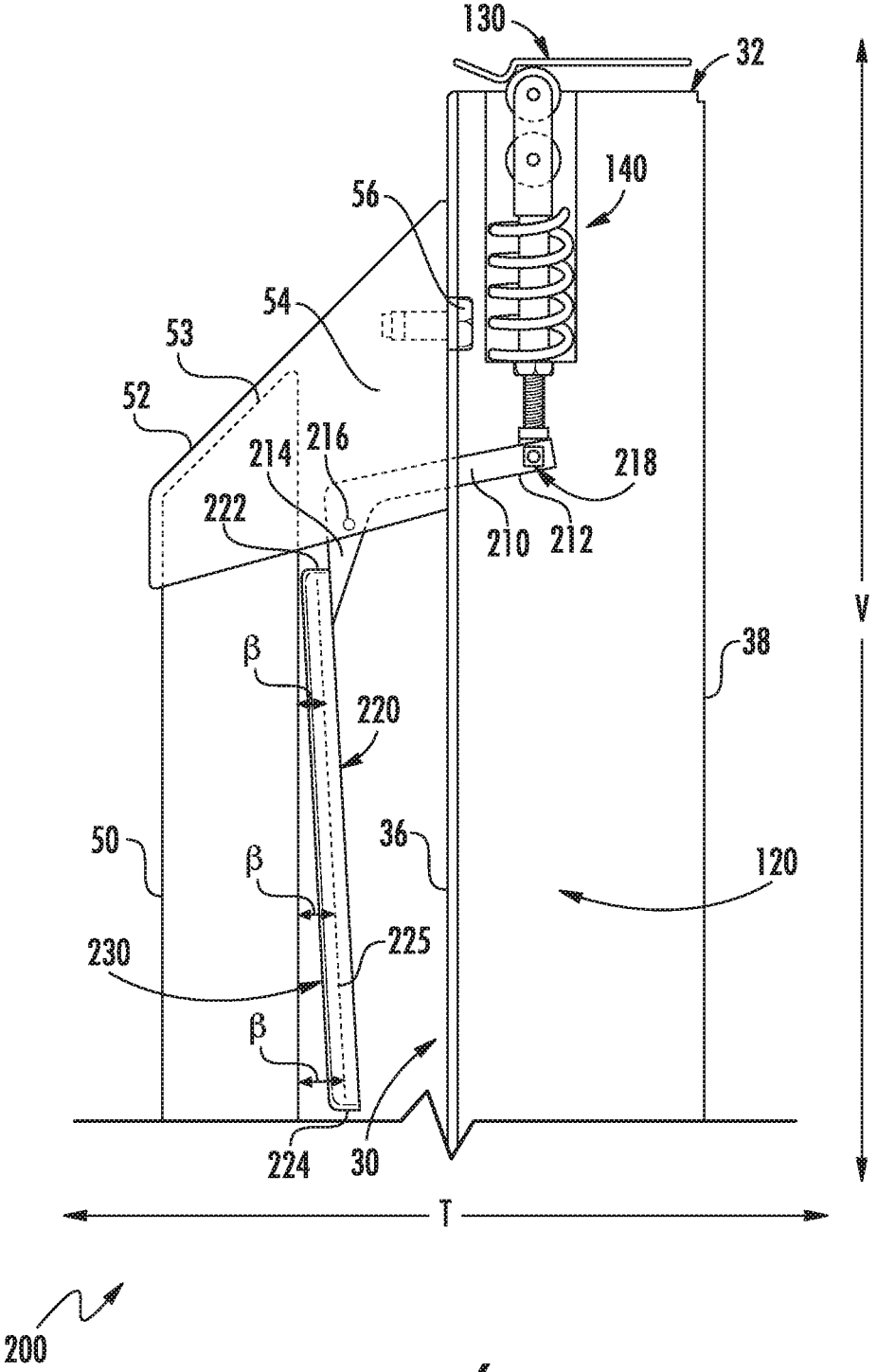
FIG. 6 depicts a trigger of the exemplary door assembly of FIG. 5 in a first position.
Figure 7:
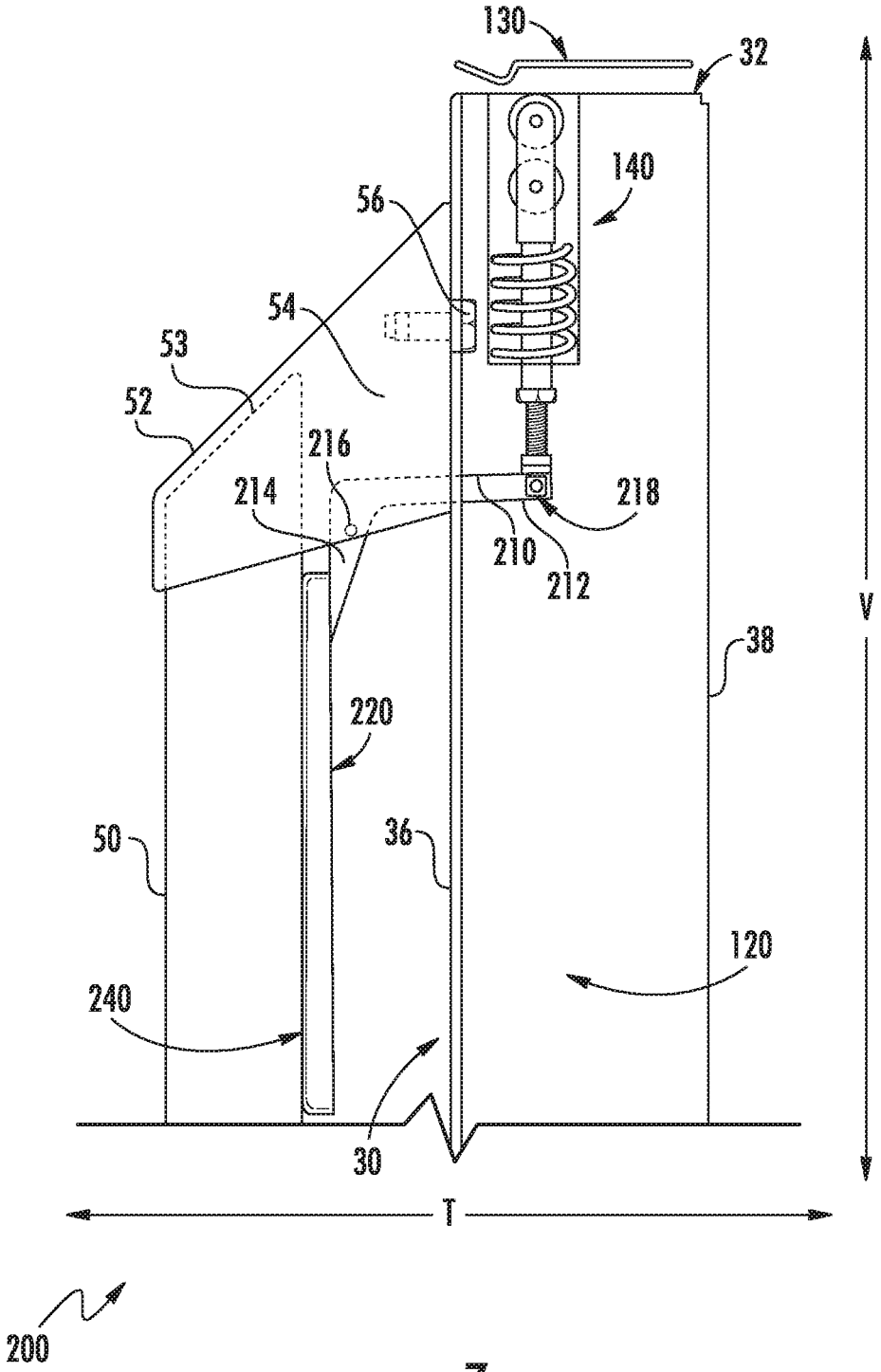
FIG. 7 depicts a trigger of the exemplary door assembly of FIG. 5 in a second position.

FIGS. 5-7 depict an exemplary door assembly 200 comprising a latch assembly 140, a linkage arm 210, and a trigger 220. The latch assembly 140 is configured in substantially the same manner as the exemplary latch assembly 140 depicted in FIG. 4, and accordingly, the same or similar numbers may refer to the same or similar parts. The linkage arm 210 includes a first end 212 and a second end 214. The first end 212 may be disposed within the cavity 120 formed by the door 30, and the second end 214 may be secured to the trigger 220. In particular, the first end 212 may be rotatably coupled to the second end 164 of the rod 160. The linkage arm 210 may extend from the first end 212 to the second end 214 through an opening formed in the door 30. More specifically, the opening may be formed in the front wall 36, and the opening may be aligned with the mounting bracket 52 along the vertical direction V. Thus, the linkage arm 210 may extend through the opening and into the cavity 54 defined by the mounting bracket 52. Further, the linkage arm 210 may extend from the cavity 54 to the second end 214. It should be appreciated, however, that the linkage arm 210 may be integrally formed with the trigger 220. More specifically, in some embodiments, the linkage arm 210 and trigger 220 may be a single component.

The linkage arm 210 may define an aperture 216 positioned between the first end 212 and the second end 214. More specifically, the linkage arm 210 may be oriented such that a portion of the linkage arm 210 defining the aperture 216 is positioned within the cavity 54 formed by the mounting bracket 52. Further, the aperture 216 may be aligned with an aperture (not shown) formed in the mounting bracket 52, and a mechanical fastener (also not shown) may extend through the aperture formed in the mounting bracket 52 and the aperture 216 formed in the linkage arm 210. Accordingly, the linkage arm 210 may be coupled to the mounting bracket 52 via the mechanical fastener. Further, the first and second ends 212, 214 may each be rotatable about the aperture 216.

The linkage arm 210 may also define an opening or slot 218 positioned at the first end 212 of the linkage arm 210. The slot 218 may extend along the vertical direction V and, as will be discussed below in more detail, may prohibit inadvertent movement of the trigger 220 when the door 30 is moving from the open position to the closed position.

The trigger 220 includes a first end 222 and a second end 224. The first end 222 is positioned adjacent the second end 214 of the linkage arm 210. The second end 224 is spaced apart from the first end 222 along the vertical direction V. The trigger 220 defines a centerline axis 225 extending from the first end 222 to the second end 224 along the vertical direction V. The trigger 220 also includes an inner surface 226 and an outer surface 228. The inner surface 226 faces the handle 50, and the outer surface 228 faces the door 30. As discussed below in more detail, the trigger 220 is movable between a first position 230 (FIG. 6) and a second position 240 (FIG. 7).

In the first position 230, the latch 150 (FIG. 4) engages the catch 130 to lock the door 30 in the closed position. As the trigger 220 moves from the first position 230 to the second position 240, the latch 150 disengages the catch 130, because the linkage arm 210 moves the latch assembly 140 along the vertical direction V. More specifically, the linkage arm 210 rotates in a first direction 250 and, as a result, pulls the rod 160 towards the bottom wall 34 (FIG. 1) of the door 30. As follows, the latch 150 moves towards the bottom wall 146 of the housing 142, and the spring 170 becomes compressed between the bottom wall 152 of the latch 150 and the bottom wall 146 of the housing 142.

Additionally, as the latch 150 moves towards the bottom wall 146 of the housing 142, the second end 164 of the rod 160 moves within the slot 218 along the vertical direction V. More specifically, the second end 164 of the rod 160 moves towards the bottom wall 34 (FIG. 1) of the door 30. Thus, the length of the slot 218 along the vertical direction V may be sized to accommodate movement of the second end 164 of the rod 160 along the vertical direction V when the door 30 moves from the open position (FIG. 1) to the closed position (FIG. 2). As such, the slot 218 may prevent transfer of motion from the rod 160 to the linkage arm 210 when the door 30 moves from the open position to the closed position. Furthermore, since the slot 218 prevents movement of the linkage arm 210, the slot 218 prevents inadvertent movement of the trigger 220 towards the handle 50. Accordingly, the slot 218 prevents a user's hand from becoming pinned between the handle 50 and the trigger 220 when the user is moving the door 30 from the open position to the closed position.

In an alternative embodiment, the first end 212 of the linkage arm 210 may be coupled to the second end 164 of the rod 160 via a flexible wire. The flexible wire may be uncompressed when the door 30 is in the open position.

However, as the door 30 moves from the open position to the closed position, the flexible wire may become compressed between the bottom wall 146 of the housing 142 and the bottom wall 34 of the door 30. More specifically, as the catch 130 moves the latch 150 towards the bottom wall 146 of the housing 142 along the vertical direction V, the second end 164 of the rod 160 moves towards the bottom wall 34 of the door 30 along the vertical direction V. As such, the flexible wire becomes compressed between the bottom wall 146 of the housing 142 and the bottom wall 152 of the latch 150. Accordingly, the flexible wire absorbs motion of the latch 150 along the vertical direction V and prevents transfer of said motion to the linkage arm 210. Furthermore, since the flexible wire prevents movement of the linkage arm 210, the flexible wire prevents inadvertent movement of the trigger 220 towards the handle 50. As a result, the flexible wire prevents a user's hand from becoming pinned between the handle 50 and the trigger 220 when the user is moving the door 30 from the open position to the closed position.

As shown in FIG. 6, the centerline axis 225 and the handle 50 form an angle β therebetween when the trigger 220 is in the first position 230. Further, the angle β varies along a length L of the trigger 220 which, as shown in FIG. 6, may be defined between the first end 222 and the second end 224 along the vertical direction V. In particular, the angle β measured at the first end 222 is less than the angle β measured at the second end 224. As the trigger 220 moves to or towards the second position 240, the angle β decreases, because the trigger 220 moves towards the handle 50. In one embodiment, the angle β is equal to zero (0) when the trigger 220 is in the second position 240, because both the first and second ends 222, 224 contact an outer surface of the handle 50.

Figure 8:
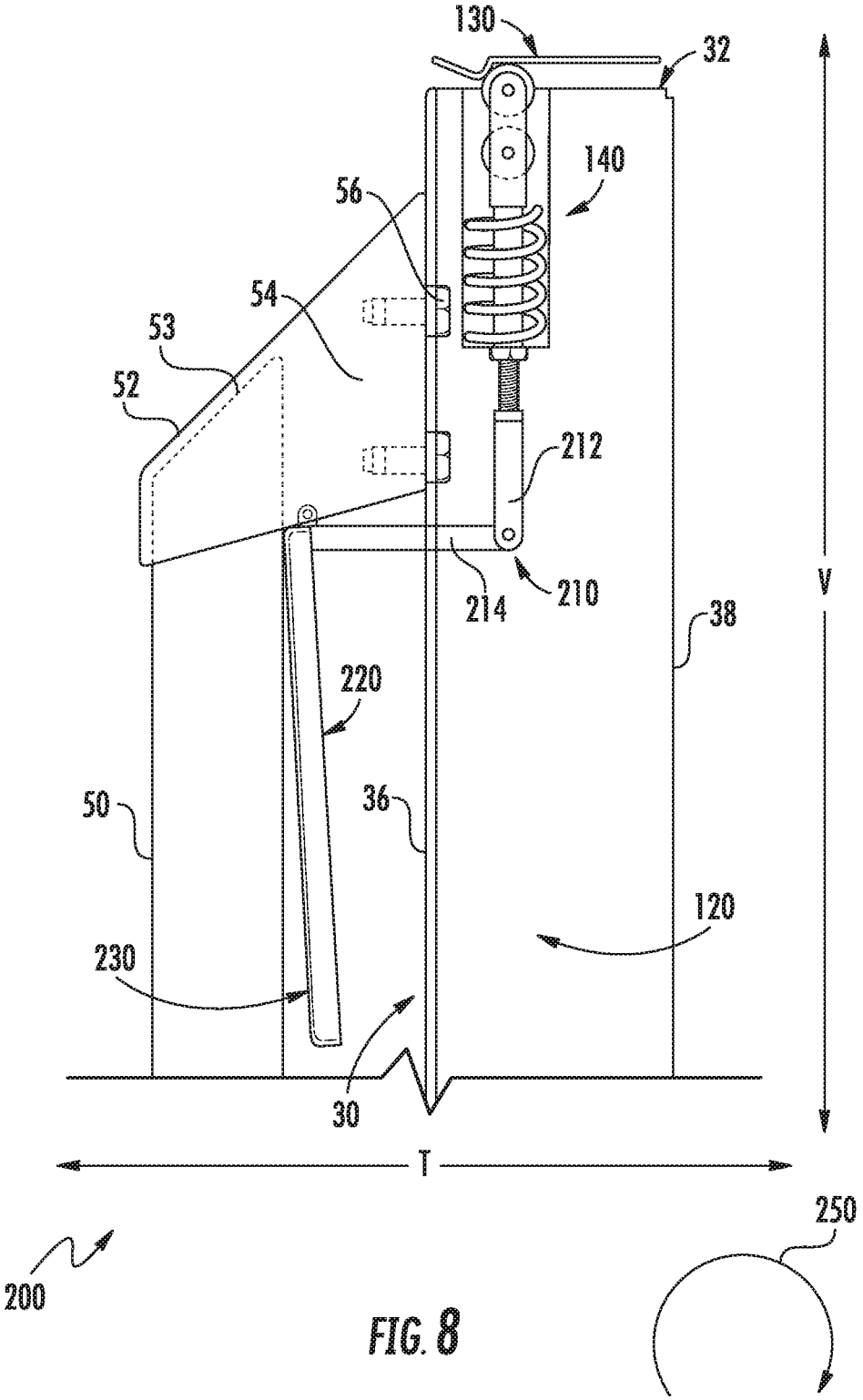
FIG. 8 depicts a side view of another exemplary door assembly in accordance with the present subject matter.

FIG. 8 provides a side view of a door assembly 200 in accordance with another exemplary embodiment of the present subject matter. The exemplary door assembly 200 depicted in FIG. 8 may be configured in substantially the same manner as the exemplary door assembly 200 depicted in FIG. 5, and accordingly, the same or similar numbers may refer to the same or similar parts. For example, the door assembly 200 includes a latch assembly 140 and a trigger 220.

However, for the embodiment of FIG. 8, the linkage arm 210 includes a first linkage arm 212 and a second linkage arm 214. The first linkage arm 212 may be disposed within the cavity 120 formed by the door 30. More specifically, the first linkage arm 212 may be attached to the second end 162 of the rod 160. The second linkage arm 214 may be rotatably coupled to the first linkage arm 212. Further, the second linkage arm 214 may extend from the cavity 120 formed by the door 30 to the trigger 220 through an opening formed in the front wall 36 of the door 30. More specifically, the second linkage arm 214 may extend through the opening and directly to the trigger 220. In other words, the second linkage arm 214 does not extend from the cavity 120 to the trigger 220 via the cavity 54 formed in the mounting bracket 52.

As the trigger 220 rotates towards the handle 50, the second linkage arm 214 simultaneously rotates in the first direction 250 and moves the latch assembly 140 along the vertical direction V. In particular, the second linkage arm 214 pulls the first linkage arm 212 towards the bottom wall 34 of the door 30. Further, since the first linkage arm 212 is attached to the rod 160, the first linkage arm 212 pulls the latch 150 towards the bottom wall 34 of the door 30 along the vertical direction V. Still further, as the latch 150 moves towards the bottom wall 34 of the door 30, the latch 150, specifically the bottom wall 152 thereof, compresses the spring 170 against the bottom wall 146 of the housing 142.

Figure 9:
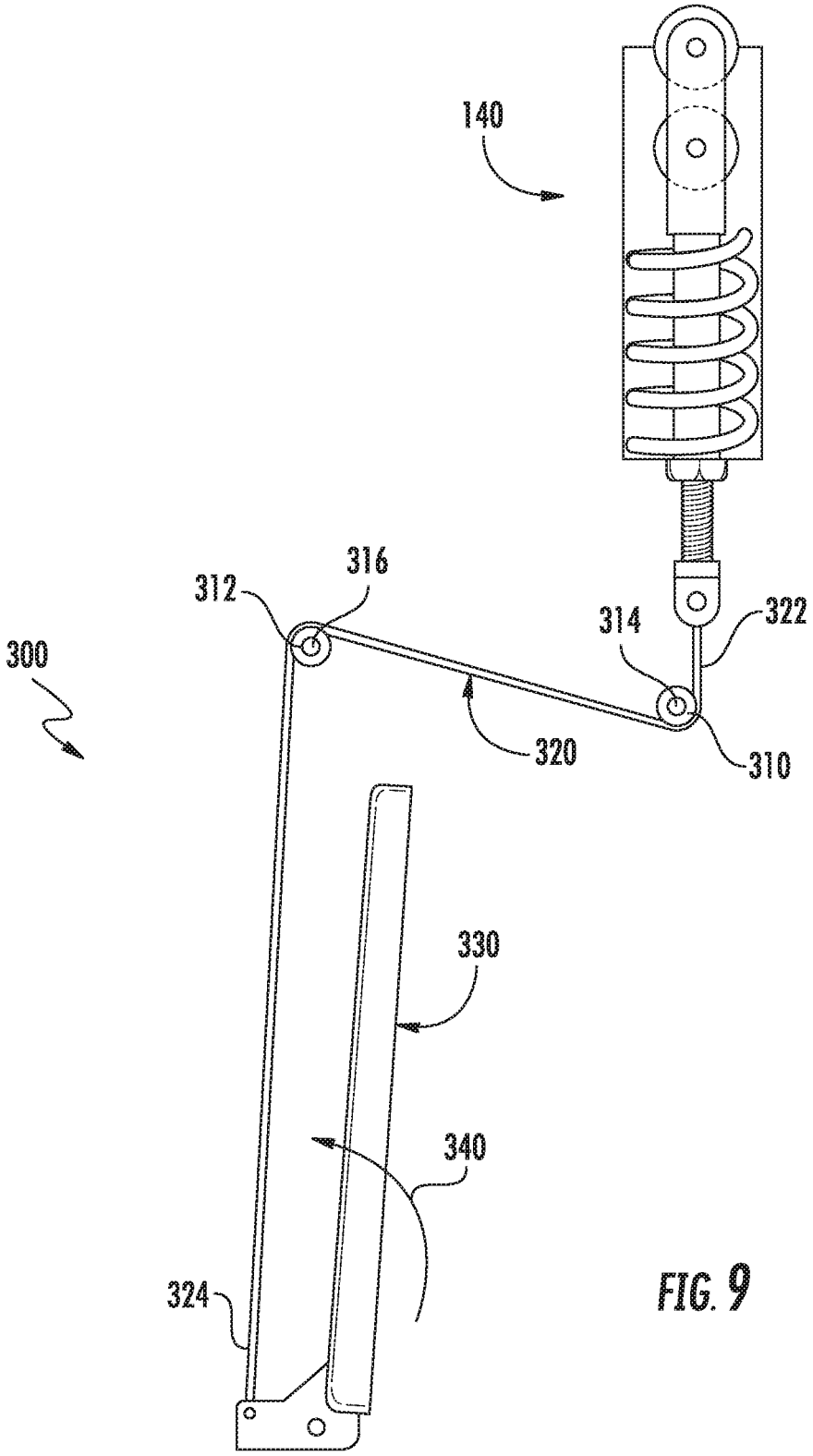
FIG. 9 depicts a side view of yet another exemplary door assembly in accordance with the present subject matter.
Figure 10:
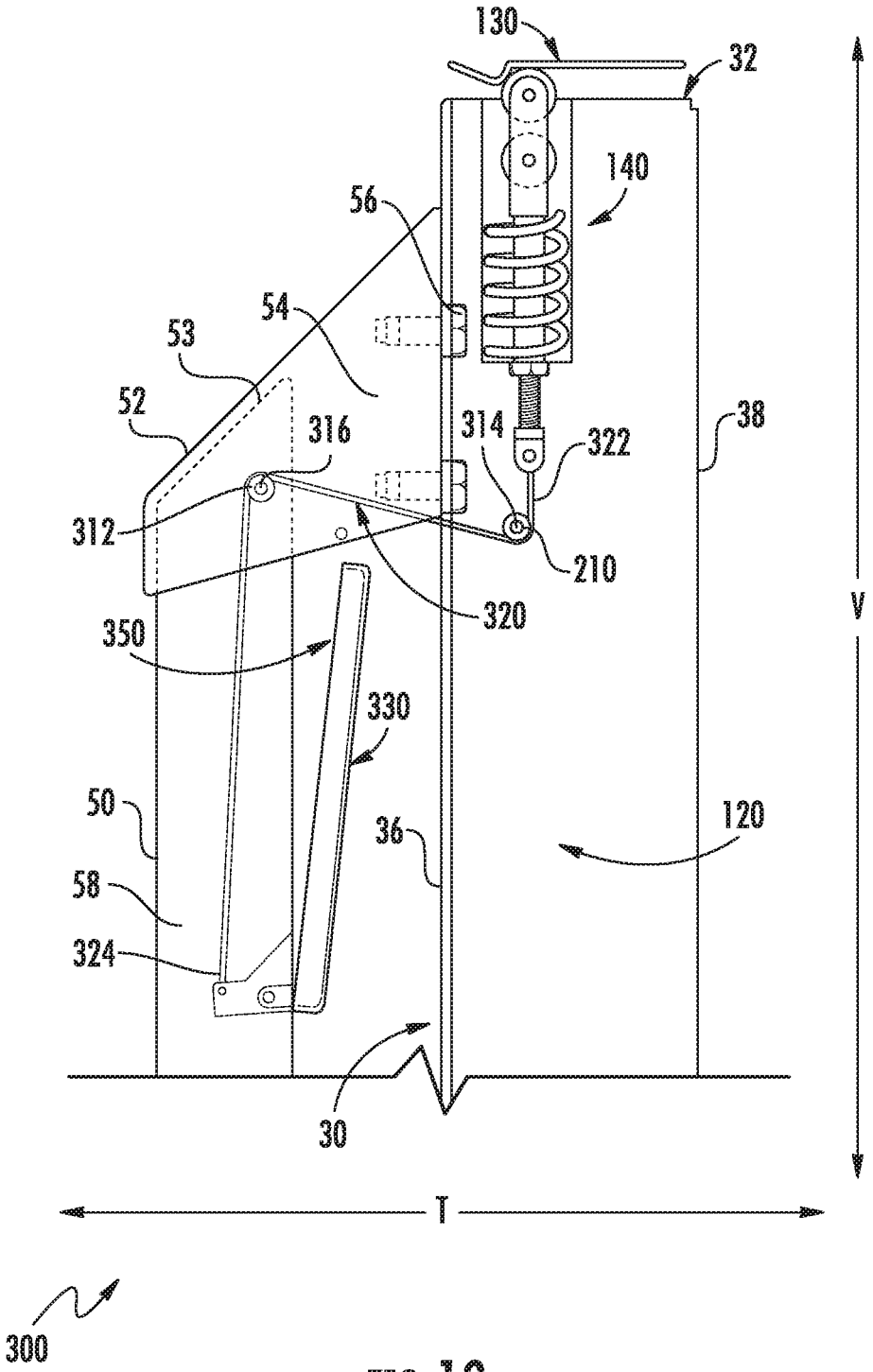
FIG. 10 depicts a trigger of the exemplary door assembly of FIG. 9 in a first position.
Figure 11:
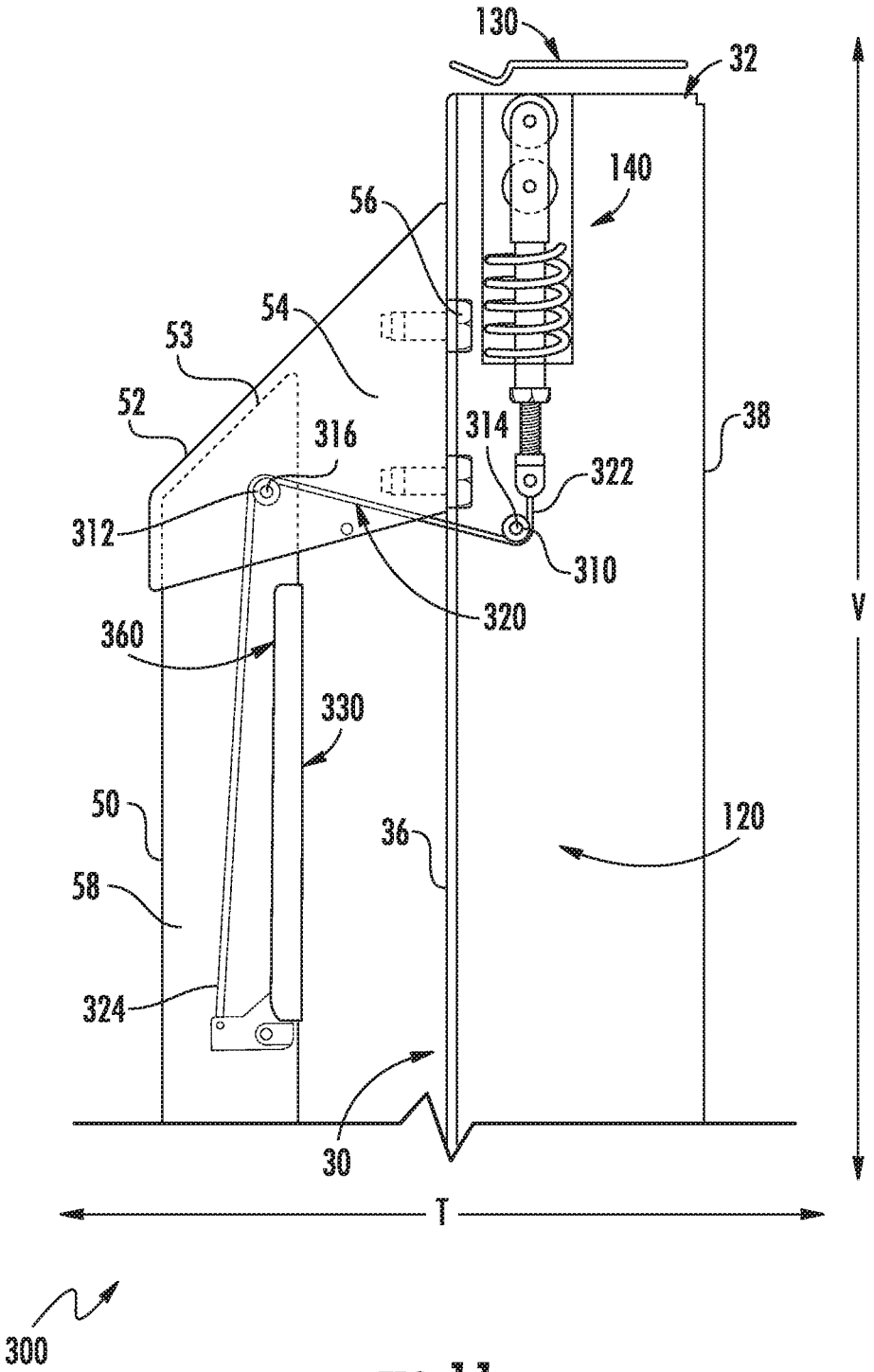
FIG. 11 depicts a trigger of the exemplary door assembly of FIG. 9 in a second position.

FIGS. 9-11 depict another exemplary door assembly 300 comprising a latch assembly 140, first and second pulleys 310 and 312, a wire 320, and a trigger 330. The latch assembly 140 is configured in substantially the same manner as the exemplary latch assembly 140 depicted in FIG. 4, and accordingly, the same or similar numbers may refer to the same or similar parts. The first pulley 310 may be disposed within the cavity 120 formed by the door 30, and the second cavity 312 may be positioned with the cavity 54 formed by the mounting bracket 52. Further, a center 314 of the first pulley 310 may be spaced apart from a center 316 of the second pulley 312 along the vertical direction V. More specifically, the center 316 of the second pulley 312 may be positioned above the center 314 of the first pulley 310 along the vertical direction V.

The wire 320 includes a first end 322 and a second end 324. The first end 322 of the wire is coupled to the second end 164 of the rod 160. The wire 320 extends from the first end 322 and wraps around a portion of the first pulley 310. The wire 320 then extends through an opening formed in the front wall 36 of the door 30 and into the cavity 54 formed by the mounting bracket 52. The wire 320 then wraps around a portion of the second pulley 312 and extends into an interior chamber 58 defined by the handle 50. In particular, the wire 320 extends to the second end 324 which, as shown in FIGS. 10 and 11, may be attached to a portion of the trigger 330 positioned within the interior chamber 58.

The trigger 330 is rotatable in a first direction 340. As the trigger 330 rotates in the first direction 340, the trigger 330 moves from a first position 350 (FIG. 10) to a second position 360 (FIG. 11). In the first position 350, the latch 150 (FIG. 4) engages the catch 130 to lock the door 30 in the closed position (FIG. 2). In contrast, the latch 150 disengages the catch 130 as the trigger 330 moves from the first position 350 to or towards the second position 360. As the trigger 330 rotates in the first direction 340, the trigger 330 pulls the wire 320 and causes the first and second pulleys 310, 312 to rotate in opposing directions. More specifically, the wire 320 pulls the rod 160 towards the bottom wall 34 (FIG. 1) of the door 30. As follows, the latch 150 moves towards the bottom wall 146 of the housing 142, and the spring 170 becomes compressed between the bottom wall 152 of the latch 150 and the bottom wall 146 of the housing 142.

Figure 12:
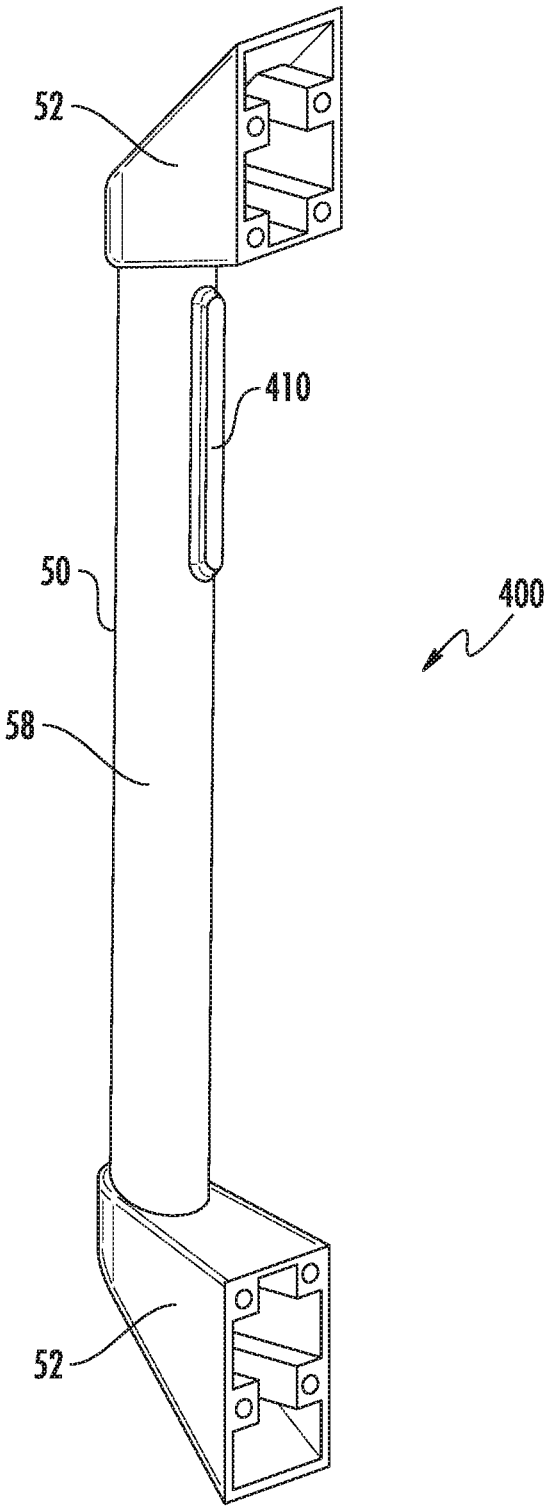
FIG. 12 depicts another exemplary trigger of the door assembly of FIG. 9.

FIG. 12 depicts a door assembly 400 in accordance with yet another exemplary embodiment of the present subject matter. The exemplary door assembly 400 depicted in FIG. 12 may be configured in substantially the same manner as the exemplary door assembly 200 depicted in FIG. 9, and accordingly, the same or similar numbers may refer to the same or similar parts. For example, the door assembly 400 may include a latch assembly 140 and a trigger 220.

However, for the embodiment of FIG. 12, the trigger 410 may be recessed within the interior chamber 58 of the handle 50. More specifically, a first portion of the handle 50 may be positioned within the recess when the trigger 410 is in the first position 350. Further, a second portion of the handle 50 may be positioned within the recess when the trigger 410 is in the second position 360. The second portion may be different than the first portion. More specifically, the second portion may be greater than the first portion.

In general, the exemplary embodiments mentioned above and depicted in FIGS. 5-12 provide various advantages. In particular, the exemplary door assemblies reduce the amount of force required to move doors from a closed position to an open position. For example, the door assemblies may be employed on oven appliances having French doors to reduce the amount of force required to move each of the French doors from a closed position (FIG. 2) to an open position (FIG. 1). It should be appreciated, however, that the exemplary door assemblies mentioned above are not limited to oven appliances. For example, the exemplary door assemblies may be utilized on a variety of appliances such as, without limitation a refrigerator, a freezer, a dishwasher, a dryer, or any other suitable appliance.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An appliance defining a vertical direction, the appliance comprising:

a door defining a cavity accessible through an opening formed on the door;

a catch spaced apart from the door along the vertical direction; and a door assembly comprising:

a latch assembly comprising a housing, a latch and a rod, the housing disposed within the cavity defined by the door, the latch disposed within a cavity defined by the housing and movable along the vertical direction, the rod extending from the latch along the vertical direction and through an opening formed in the housing such that a first end of the rod is disposed within the cavity defined by the housing and a second end of the rod is disposed within the cavity defined by the door;

a linkage arm comprising a first end and a second end, the first end of the linking arm coupled to the second end of the rod; and a trigger coupled to the second end of the linking arm, the trigger movable between a first position and a second position, wherein the latch engages the catch when the trigger is in the first position, wherein the latch is spaced apart from the catch along the vertical direction when the trigger is in the second position, and wherein when the trigger moves between the first position to the second position, the rod moves along the vertical direction within a slot defined by the linkage arm.

2. The appliance of claim 1, wherein the latch assembly further comprises a spring positioned within the cavity defined by the housing such that the spring is positioned between the latch and a bottom wall of the housing along the vertical direction.

3. The appliance of claim 2, wherein when the trigger is in the second position, a bottom wall of the latch compresses the spring against the bottom wall of the housing.

4. The appliance of claim 1, wherein the catch is mounted to a control panel of the appliance.

5. The appliance of claim 1, wherein the opening defined by the door is formed on a top wall of the door.

6. An oven appliance defining a vertical direction, the oven appliance comprising:

a cabinet defining a cooking chamber configured for receipt of food items for cooking, the cabinet further defining an opening at a front portion of the cabinet;

a door mounted to the cabinet, the door being selectively adjustable between an open position and a closed position to permit selective access to the cooking chamber through the opening of the cabinet, the door defining a cavity accessible through an opening formed on the door;

a handle mounted to the door;

a catch spaced apart from the door along the vertical direction; and a door assembly comprising:

a latch assembly comprising a housing, a latch and a rod, the housing disposed within the cavity defined by the door, the latch disposed within a cavity defined by the housing and movable along the vertical direction, the rod extending from the latch along the vertical direction and through an opening formed in the housing such that a first end of the rod is disposed within the cavity defined by the housing and a second end of the rod is disposed within the cavity defined by the door;

a linkage arm comprising a first end and a second end, the first end of the linking arm coupled to the second end of the rod; and trigger coupled to the second end of the rog, the trigger movable between a first position and a second position, wherein the latch engages the catch when the trigger is in the first position, wherein the latch is spaced apart from the catch when the trigger is in the second position, and wherein when the trigger moves between the first position to the second position, the rod moves along the vertical direction within a slot defined by the linkage arm.

7. The oven appliance of claim 6, wherein the latch assembly further comprises a spring positioned within the cavity defined by the housing such that the spring is positioned between the latch and a bottom wall of the housing along the vertical direction.

8. The oven appliance of claim 7, wherein when the trigger is in the second position, a bottom wall of the latch compresses the spring against the bottom wall of the housing.

9. The oven appliance of claim 6, wherein the catch is mounted to a control panel of the oven appliance.

10. The oven appliance of claim 6, wherein the opening defined by the door is formed on a top wall of the door.

* * * * *